US006770141B1

(12) United States Patent
Campbell et al.

(10) Patent No.: US 6,770,141 B1
(45) Date of Patent: Aug. 3, 2004

(54) SYSTEMS FOR CONTROLLING EVAPORATIVE DRYING PROCESSES USING ENVIRONMENTAL EQUIVALENCY

(75) Inventors: Dwayne A Campbell, Durham, NC (US); Joseph T. Marranca, Wilmington, NC (US); Raymond E. Pope, Durham, NC (US); Robert Allen Stagner, Durham, NC (US)

(73) Assignee: SmithKline Beecham Corporation, Philadelphia, PA (US)

( * ) Notice: Subject to any disclaimer, the term of this patent is extended or adjusted under 35 U.S.C. 154(b) by 235 days.

(21) Appl. No.: 10/088,984

(22) PCT Filed: Sep. 29, 2000

(86) PCT No.: PCT/US00/26933

§ 371 (c)(1),
(2), (4) Date: Mar. 26, 2002

(87) PCT Pub. No.: WO01/23821

PCT Pub. Date: Apr. 5, 2001

Related U.S. Application Data

(60) Provisional application No. 60/156,673, filed on Sep. 29, 1999.

(51) Int. Cl.[7] ..... B05C 11/00

(52) U.S. Cl. ..... 118/667; 118/58; 118/300; 118/688; 118/708; 118/712; 427/8; 427/213; 427/372.2; 427/421

(58) Field of Search ..... 118/667, 688, 118/708, 712, 58, 300; 427/8, 372.2, 421, 213

(56) References Cited

U.S. PATENT DOCUMENTS

| | | | |
|---|---|---|---|
| 4,471,424 | A | 9/1984 | Persson |
| 4,704,805 | A | 11/1987 | Kaya et al. |
| 4,953,298 | A | 9/1990 | Carter et al. |

FOREIGN PATENT DOCUMENTS

| | | | |
|---|---|---|---|
| DE | 28 27 843 | A | 1/1980 |
| EP | 0 437 888 | A | 7/1991 |
| EP | 0 651 219 | A | 5/1995 |
| EP | 0 656 515 | A | 6/1995 |
| GB | 2 177 785 | A | 1/1987 |
| WO | 99 18405 | A | 4/1999 |

OTHER PUBLICATIONS

Glenn C. Ebey, "A Thermodynamic Model For Aqueous Film–Coating," *Pharmaceutical Technology*, Apr. 1987, pp. 40, 42, 43, 46, 48, 50 XP002156193.

*Primary Examiner*—Bernard Pianalto
(74) *Attorney, Agent, or Firm*—J. Michael Strickland

(57) ABSTRACT

Methods and systems for controlling evaporative drying processes using environmental equivalency control process parameters to provide a specified product quality. In an environmental equivalency-based control system, measured values are received by environmental equivalency calculation hardware or software. An environmental equivalency value is calculated based on the measured parameters. One or more of the process parameters may then be varied to maintain the environmental equivalency value for the process within a predetermined range of environmental equivalency values.

42 Claims, 4 Drawing Sheets

SYSTEMS FOR CONTROLLING EVAPORATIVE DRYING PROCESSES USING ENVIRONMENTAL EQUIVALENCY

This application is filed pursuant to 35 U.S.C. §371 as a U. S. National Phase Application of International Application No. PCT/US00/26933 filed Sep. 29, 2000, which claims priority from U.S. application Ser. No. 60/156,673 filed Sep. 29, 1999.

TECHNICAL FIELD

The present invention relates to methods and systems for controlling evaporative drying processes. More particularly, the present invention relates to methods and systems for controlling evaporative drying processes using environmental equivalency.

BACKGROUND ART

Evaporative drying processes, such as tablet film coating, spray drying, and fluid bed processing, utilize evaporative drying to achieve a desired output product quality. For example, in tablet film coating, tablets are placed in the coating pan of a tablet coater. The coating pan is a perforated or semi-perforated cylinder, similar in appearance to the tumbler of a conventional clothing dryer. The coating pan rotates as a coating material, such as a solution or a suspension, is sprayed onto the tablets. In order to dry the coating material on the tablets, a heated gas, such as air, is pumped or drawn into the chamber through a gas inlet. The gas evaporates liquid from the coating material and exits through a gas outlet.

Some of the parameters associated wit tablet film coating are:

drying gas temperature;

dew point;

drying gas flow rate;

spray rate; and solution/dispersion percentage of solids.

In order to achieve proper coating of tablets using conventional methods, optimal values for each of these parameters must be determined empirically. In addition, subsequent processes must be carefully controlled to ensure that the optimal parameter values are maintained.

In order to determine optimal values for tablet film coating parameters, many experiments must be performed. For example, a process technician may start coating tablets in a tablet coater using initial values for the above-listed parameters. The quality of the coating of the tablets may be analyzed to determine required adjustments in the parameters. This process is repeated until optimal values are determined for the parameters. The optimal parameter values are then programmed into a control device, such as a programmable logic controller, to control subsequent coating of tablets.

The empirical method for determining optimal parameter values is undesirable for a variety of reasons. When multiple tests are required in order to determine optimal parameter values, many hours of tablet coater operation are required. As a result, a pharmaceuticals manufacturing company may be required to slow production or purchase multiple tablet coaters in order to maintain a given production level. The increased time and/or equipment required to empirically determine optimal process parameters undesirably increases the cost of developing evaporative drying processes, such as tablet film coating.

Another problem associated with conventional development of evaporative drying processes is that conventional development of evaporative drying processes is product specific. In other words, experimental tests must be performed for each new product to determine optimal process parameters. This testing undesirably increases labor and expense associated with conventional evaporative drying processes.

Another reason that the conventional empirical method of determining optimal process parameter values is undesirable is that results may not be scalable. For example, parameter values determined for a small tablet coater may not be valid for a larger tablet coater and vice versa. As a result, new parameter values may have to be determined when the scale of a process changes. In addition, model parameters that hold true for one processing environment may not be transferrable to another processing environment. For example, parameter values for a tablet film coating process operating in one geographic area with a high relative humidity may not be transferrable to another geographic area with a low relative humidity. As a result, empirical tests must be performed in the new geographic area to determine optimal parameter values for the new area. This lack of scalability and transferability associated with conventional tablet film coating process control results in increased labor and expense.

Still another problem associated with tablet film coating is the time required to start coating tablets. For example, in convention tablet coating minutes or even hours may be required to reach operating parameter values. This increased startup time decreases production for a given tablet coater.

Yet another problem associated with conventional tablet film coating is that when one or more process parameters change during a tablet coating operation, this change may adversely affect output product quality. For example, if inlet air humidity or temperature changes during a tablet coating operation, other parameters may require adjustment during the operation in order to compensate for the changes. Such compensation may require continuous monitoring and manual adjustment by an operator throughout the tablet coating process. Thus, conventional methods for manufacturing pharmaceutical products may be labor-intensive.

"A Thermodynamic Model for Aqueous Film-Coating", *Pharmaceutical Technology*, April 1987, by Glenn C. Ebey of Thomas Engineering, describes a dimensionless quantity, referred to as environmental equivalency (EE), that can be used to model relationships between process parameters associated with aqueous film coating. In the publication, an example is given where environmental equivalency is used to determine a new inlet air temperature for a tablet coater to produce a desired environmental equivalency value when inlet air humidity changes. The new inlet air temperature is determined as follows. First, the example states that "a good quality of coating can be obtained at an inlet air temperature of 149□F, an air flow rate of 2000 actual cubic feet per minute, a humidity ratio of 25 grains per pound mass, and a spray rate of 400 grams per minute, using a solution of 10% solids". Based on these parameters, an EE value of 2.990 is calculated. The humidity of the processing environment changes to 125 grains per pound mass. The inlet air temperature required to maintain the same EE value is then calculated. In the example, the resulting inlet air temperature is 160□F in order to achieve the same EE value.

While the publication describes, in theory, a method for modeling film coating processes using environmental equivalency, the example reiterated above only demonstrates how to change one variable associated with a film coating process to compensate for a step change in another variable, while the remaining parameters are held constant. In a real tablet coating system, multiple parameters may change and/or require adjustment during a tablet coating operation. Such multi-variable changes and adjustments are not addressed in the publication.

Another shortcoming of the publication is that a control system for continuously adjusting process parameters to maintain EE values is not disclosed. In the example stated above, when the humidity changes from 25 to 125 grains per pound mass, a new inlet air temperature is calculated such that the EE value will be 2.9. Such calculations may be useful for a step change in humidity, such as that which occurs when a process is moved from one geographical location to another and humidity remains constant at the new location. However, in real systems, process parameters may vary sinusoidally about setpoints, as determined by time constants of the respective control systems for process parameters. Thus, it is desirable in a real system to continuously measure process parameters and use the measured values to maintain a desired EE value.

Yet another shortcoming of the publication is that it does not address preferred ranges of EE values for tablet film coating. Finally, the publication does not address the application of environmental equivalency control to evaporative drying processes other than aqueous tablet film coating, such as spray drying, fluid bed processing, or other evaporative drying processes.

In light of these difficulties, there continues to exist a long-felt need in the pharmaceuticals industry and other industries that utilize evaporative drying for improved methods and systems for controlling processes using environmental equivalency.

SUMMARY OF THE INVENTION

According to the present invention, environmental equivalency-based control systems are applied to evaporative drying processes, such as tablet film coating, spray drying, textiles manufacturing, food processing, deposition of materials on substrates in semiconductor manufacturing, painting, chemical and petro-chemical isolation or purification, contaminant removal, and fluid bed processing. Parameters associated with an evaporative drying process are continuously monitored and fed to an environmental equivalency calculator/controller. As used herein, continuously monitoring process parameters refers to sampling process parameters at fixed or variable time intervals during an evaporative drying process. The environmental equivalency calculator/controller calculates an environmental equivalency value for the process and compares the value to a preferred range of values. If the calculated environmental equivalency value is not within the desired range of values, the environmental equivalency calculator/controller calculates a value for one or more parameters associated with the evaporative drying process and applies the new parameter value to the process. In this manner, the environmental equivalency-based control systems according to the present invention are capable of maintaining the environmental equivalency value for a process within a desired range of values. As a result, consistent product quality can be achieved, even when parameters change during the operation being performed. In addition, because control systems that use environmental equivalency are product-independent, the overall efficiency of a process is increased.

Environmental equivalency may also be used in the process transfer of evaporative drying processes, such as tablet coating, fluid bed processing, spray drying, textiles manufacturing, food processing, deposition of materials on substrates in semiconductor manufacturing, painting, chemical and petro-chemical isolation or purification, and contaminant removal. As used herein, the phrase "process transfer" refers to the act of transferring the manufacture of a specific product from one manufacturing system to another, e.g., film coating the same drug product on two different models/sizes of tablet coaters. The EE value is a dimensionless value that is indicative of the rate of the drying process. The EE value can be applied to aqueous or solvent-based processing for the operation at hand. In short, it is used to describe the environmental nature of the process. The environmental nature of a process refers to the relative rates at which heat and mass are transferred into and out of the system. The EE value is computed from an explicit mathematical expression that is a function of process-dependent variables. The expression used to calculate environmental equivalency is derived from first principles utilizing mass and energy balances around the drying system.

Applied to the pharmaceutical industry, environmental equivalency is an extremely valuable tool in process transfer. Evaluation, monitoring, and control of the environmental equivalency factor can be used to directly impact the quality of the drug product being processed. In the development of a given product, the tablet coating process, for example, has an associated EE value. In the event that the tablet coating process were to be scaled-up from pilot to manufacturing level, the EE value should be matched in the larger scale equipment in order to achieve identical product quality. Likewise, this method also applies to scale-down for the production of smaller batches. Process parameters can be varied to maintain a constant EE value. Determining these process parameters in effect establishes the scaled "recipe" of the product on the specific piece of processing equipment being used.

The formula used to calculate the environmental equivalency value is derived from mass and energy balances of the process streams with application of the first law of thermodynamics to the drying system from a "black box" approach. The particular model presented here is tailored to aqueous drying processes, such as aqueous tablet film coating. The formula is as follows:

$$EE = \frac{A_H}{A_M} = \frac{\left[\frac{Mp_w}{RT_w} - \frac{Mp_f}{RT_f}\right]h_{ig}}{\rho C_p(T_f - T_B)}$$

The variables used are defined as follows:

$A_H$=Area of heat transfer $A_M$=Area of mass transfer

M=Molar weight of water [$lb_m$/lb-mole]

$p_w$=Partial pressure of water vapor at the mass transfer conditions [$lb_f/ft^2$]

$p_f$=Partial pressure of water vapor in the free air stream [$lb_f/ft^2$]

R=Universal gas constant [$lb_f$-ft/$lb_m$-mole-° R]

$T_w$=Temperature at the mass transfer conditions [° R]

$T_f$=Free air stream temperature [° R]

$h_{ig}$=Change in enthalpy of the water [BTU/$lb_m$]

□=Density of the air stream [$lb_m/ft^3$]

$C_P$=Specific heat capacity of air [BTU/$lb_n$-° F]

$T_B$=Heat transfer surface temperature [° R]

The technical definition of EE is the ratio of the area of heat transfer, $A_H$, to the area of mass transfer, $A_M$. Low EE values, near 1, characterize wet processes. Higher values indicate dryer conditions.

Although the parameters in the equation indicate removal of water from a product in air, the present invention is not limited to removing water from a product in air. For example, according to the present invention, environmental equivalency can also be applied to solvent-based drying processes and processes where drying occurs in gases other than air. For example, for tablet film coating, spray drying, fluid bed processing, or any other evaporative drying process, any of the Noble gases may be used to dry the product. In addition, organic solvents may be used to coat a product. If the solvent and/or the drying gas is modified, the variables in the equation must be changed according to the physical and chemical properties of the solvent and/or drying gas being used. In addition, the preferred range of environmental equivalency values may change for solvents other than water.

Application to Tablet Film Coating

Aqueous film coating is a core process critical to tablet dosage form manufacturing. Current methods of coating process transfer are oftentimes ineffective and involve costly multiple experimental trials in order to achieve the desired end product quality. Implementation of the EE model can eliminate these inefficiencies and ensure expedient development of scale-up production recipes.

In the application of environmental equivalency-based control to the tablet coating process, there are both constant and variable factors along with assumptions. The model assumes that the process is adiabatic and thermodynamically ideal. Adiabatic processes are those in which heat transfer to the surroundings is zero. In this case, all of the heat input to the system leaves through the process streams, not to the film coater's surroundings (the air, walls, etc. around the coater). The model is described as thermodynamically ideal because it uses the basic, fundamental equations for quantifying mass and heat transfer without consideration of non-linear properties of the chemical species involved. These assumptions hold true for the ranges of operating parameters for evaporative drying processes.

Factors and conditions that may not be incorporated in the evaluation of environmental equivalency for tablet film coating are pan speed, nozzle configuration, location of temperature sensors, load size, and tablet geometry. These factors yield insignificant effect upon heat and mass transfer and therefore do not affect the drying process.

The primary variables in aqueous tablet coating that are critical to calculating environmental equivalency values are inlet gas temperature, gas flow rate, humidity, percent solids in the coating solution, and spray rate. Changes in these variables cause changes in the environmental equivalency value. Increasing inlet gas temperature, inlet gas flow rate, and percentage solids cause an increase in the environmental equivalency value, increasing the drying rate. Increases in inlet gas humidity and spray rate cause a decrease in the environmental equivalency value, slowing the drying rate. The present invention includes methods and systems for continuously measuring and adjusting process parameter values to maintain a desired range of environmental equivalency values.

Accordingly, it is an object of the invention to provide methods and systems for controlling evaporative drying processes using environmental equivalency.

It is yet another object of the invention to provide a method for calculating a process control parameter in an environmental-equivalency-based control system.

Some of the objects of the invention having been stated hereinabove, other objects will become evident as the description proceeds, when taken in connection with the accompanying drawings as best described hereinbelow.

BRIEF DESCRIPTION OF THE DRAWINGS

A description of the invention will now proceed with reference to the accompanying drawings, of which.

DETAILED DESCRIPTION OF THE INVENTION

Figure 1:
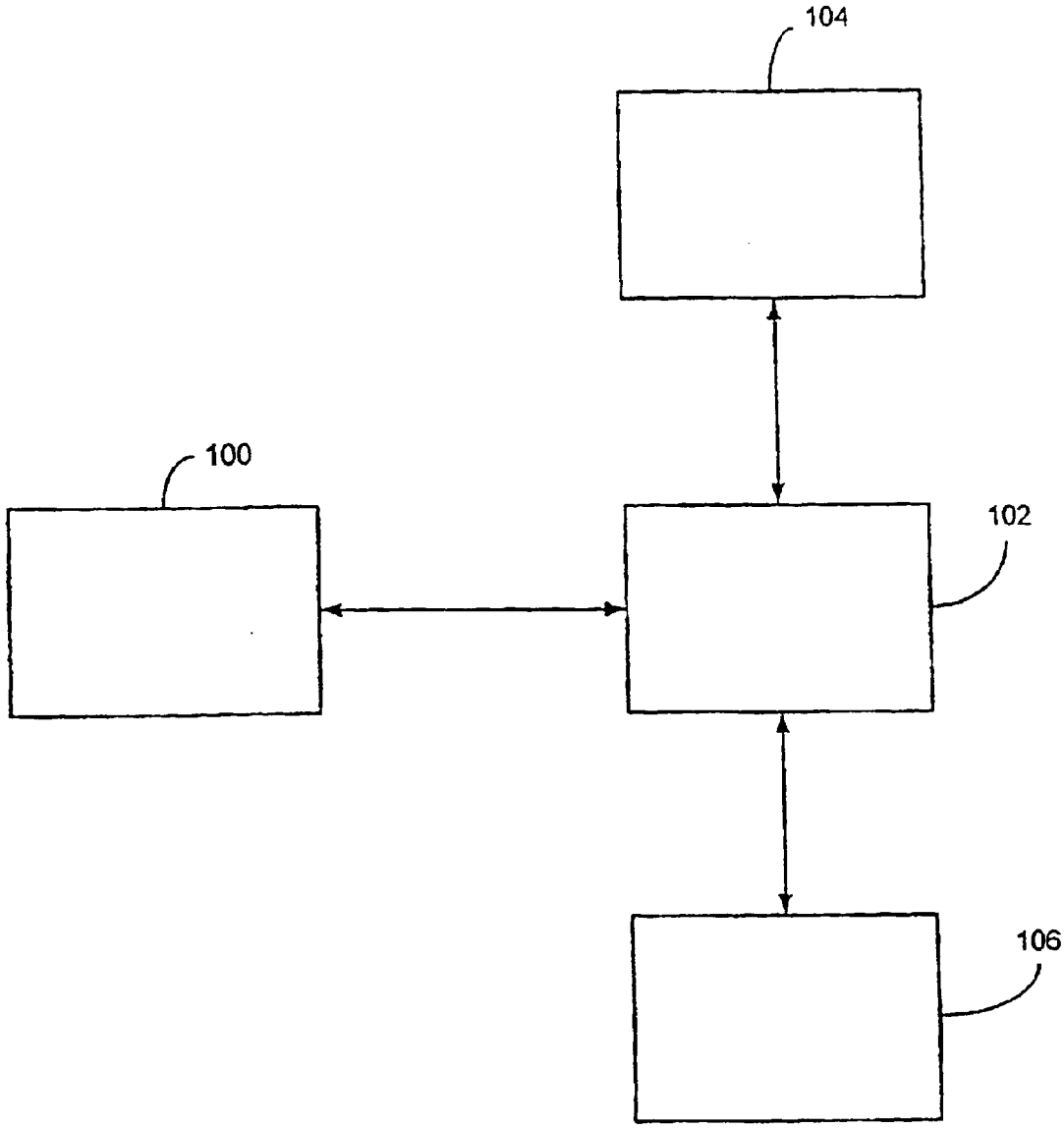
FIG. 1 is a block diagram of a tablet film coating system including an EE calculator/controller according to an embodiment of the present invention.

FIG. 1 is a block diagram illustrating a tablet film coating system including an EE calculator/controller according to an embodiment of the present invention. In FIG. 1, a tablet coater 100 apples a film coating to tablets. The tablet coater 100 may comprise any tablet coater suitable for applying a film coating to pharmaceutical tablets. Exemplary tablet coaters suitable for use with the present invention include the HI-COATER, Model No. HCF-130, available from Vector Corporation, the DRIACOATER, Model No. 500, available from Driam GMBH & Company, the GLATTPAN, available from Glatt Air Technologies, and the ACCELA-COTA, available from Thomas Engineering, Inc. As stated above, the tablet coater 100 includes a pan for holding and tumbling tablets, one or more spray nozzles for spraying a film coating on the tablets, a pump for delivering the process liquid to the spray nozzles, a gas inlet for allowing a drying gas to enter the pan, and a gas outlet for exhausting gas from the pan.

A supervisory control system 102 includes process parameter sensors and controllers that sense and control process parameters. For example, the supervisory control system 102 may include temperature sensors, such as thermocouples or resistance temperature difference (RTD) sensors, for sensing inlet gas temperature, humidity sensors for sensing humidity, and gas flow meters for sensing inlet and outlet gas flow rates. In order to control process parameters, the supervisory control 102 may include a controller, such as a programmable logic controller (PLC), or other combination of hardware, software, or hardware and software that receives the measured process parameter values and outputs control signals to maintain optimal process parameter values. A human machine interface (HMI) 104 allows the user to monitor and manually control process parameters. For example, the human machine interface 104 may comprise a computer that interfaces with the programmable logic controller and the sensors. A representative computer for use in the human machine interface 104 is a T-60 available from Allen-Bradley Corporation.

An EE calculator/controller 106 receives measured process parameter values from the sensors, calculates an environmental equivalency value based on the measured process parameter values, and outputs a control signal to the programmable logic controller based on a desired EE value. The EE calculator/controller may be implemented in hardware, software, or a combination of hardware and software. For example, in a preferred embodiment of the invention, EE calculator/controller 106 may be integrated with the programmable logic controller of the supervisory control 102. However, in the illustrated embodiment, the EE calculator/controller 106 is separate from the supervisory control 102. In such an embodiment, the EE calculator/controller 106 may be a program executing on a laptop computer that receives measured process parameters and outputs control signals through the serial port of the computer. A suitable laptop computer would be a THINKPAD® available from IBM Corporation.

Figure 2:
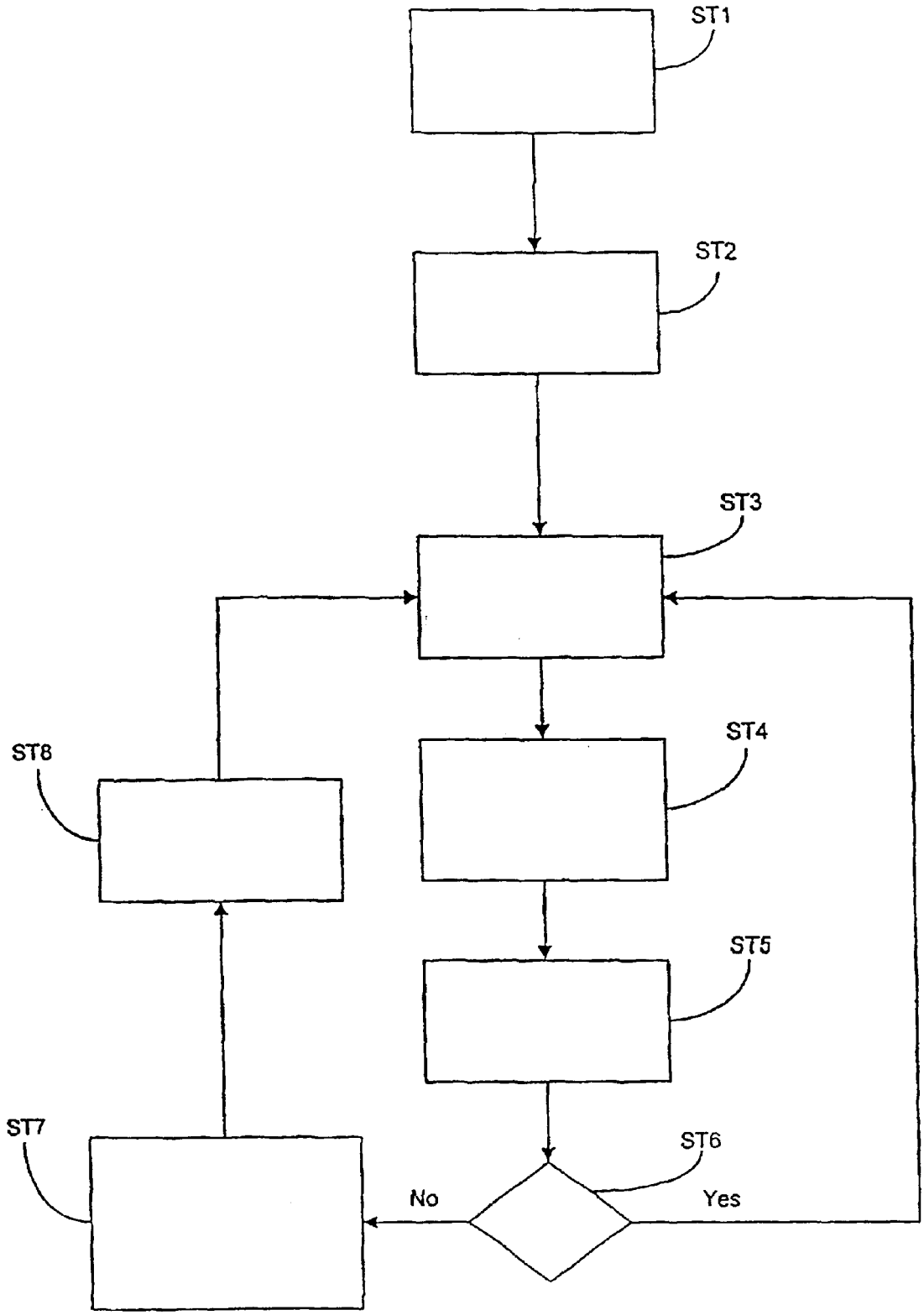
FIG. 2 is a flow chart illustrating an EE calculator/controller according to an embodiment of the present invention.

FIG. 2 is a flow chart illustrating exemplary steps that may be performed by EE calculator/controller 106 according to an embodiment of the present invention. In step ST1, the EE calculator/controller 106 receives initial process parameter values from the user. The initial process parameter values may be received from the operator through the HMI 104. Initial process parameters that may be specified include inlet gas temperature, dew point, drying gas flow rate, spray rate, and solution or dispersion percentage of solids. In step ST2, the EE calculator/controller 106 starts the tablet coating process using the initial process parameter values. Steps ST1 and ST2 are applicable to a direct control embodiment where the EE calculator/controller 106 is integrated with the supervisory control 102. In an embodiment where the EE calculator/controller is not incorporated in the supervisory control 102, steps ST1 and ST2 may be omitted because these functions would be performed externally to the EE calculator/controller 106.

In step ST3, the EE calculator/controller 106 receives measured process parameter values. The measured process parameter values may include inlet gas temperature, dew point, drying gas flow rate, spray rate, and solution or dispersion percentage of solids. In a preferred embodiment of the invention, inlet gas temperature, dew point, and gas flow rate are continuously measured. The solution or dispersion percentage of solids may also be measured. However, its value is may be known in advance, based on the film coating mixture. In step ST4, the EE calculator/controller 106 calculates an environmental equivalency value based on the measured parameter values. In steps ST5 and ST6, the EE calculator/controller 106 determines whether the calculated EE value is within a predetermined range. In a preferred embodiment, for aqueous film coating, the EE setpoint is preferably about 4.41. An EE setpoint of about 4.41 results in tablets that meet Military Standard 105 E for an acceptable quality limit (AQL) of 0.65 for aqueous film coating. A range of EE factors that results in tablets within a 95% confidence interval for an AQL of 0.65 is from about 3.74 to no more than about 5.20. Accordingly, for tablet film coating, the preferred range of EE values may be programmed into the EE calculator/controller 106 in advance.

Physical design elements of process machinery, such as tablet film coaters, may result in offsets to preferred ranges a EE values. For example, sensing element location, pan design, and other parameters may produce offsets in the preferred EE range. Offsets for individual machines may be determined experimentally by analyzing product output quality. However, the confidence interval described above takes the offsets into account for multiple coating pans of similar operating principles but of diverse capacities, e.g., 1 kg to 400 kg.

In step ST6, if the EE calculator/controller 106 determines that the environmental equivalency value is not within the desired range, the EE calculator/controller 106 computes new values for one or more process parameters so that the EE value will be within the desired range (step ST7). For example, the EE calculator/controller 106 may calculate new values for inlet gas temperature, dew point, drying gas flow rate, and/or spray rate. In a preferred embodiment, the EE calculator/controller 106 calculates a new value for the spray rate. A preferred method for calculating a new value for the parameter or parameters being controlled to achieve a desired EE value will be discussed in more detail below. In step ST8, the EE calculator/controller 106 applies the newly calculated value or values to the process.

After varying the process parameter value or values, the EE calculator/controller 106 returns to step ST3 and receives new measured process parameter values. The new process parameter values are used to calculate a new environmental equivalency value. The new environmental equivalency value is checked to determine whether it is within the desired range. Process parameter values may again be varied if the environmental equivalency value is not within the desired range. The system preferably repeats steps ST3 through ST8 continuously to achieve and maintain the desired environmental equivalency value. Because the EE value is updated continuously, product quality is maintained, even if one or more of the measured parameter values changes.

Control Parameter Calculation Routine

Figure 3:
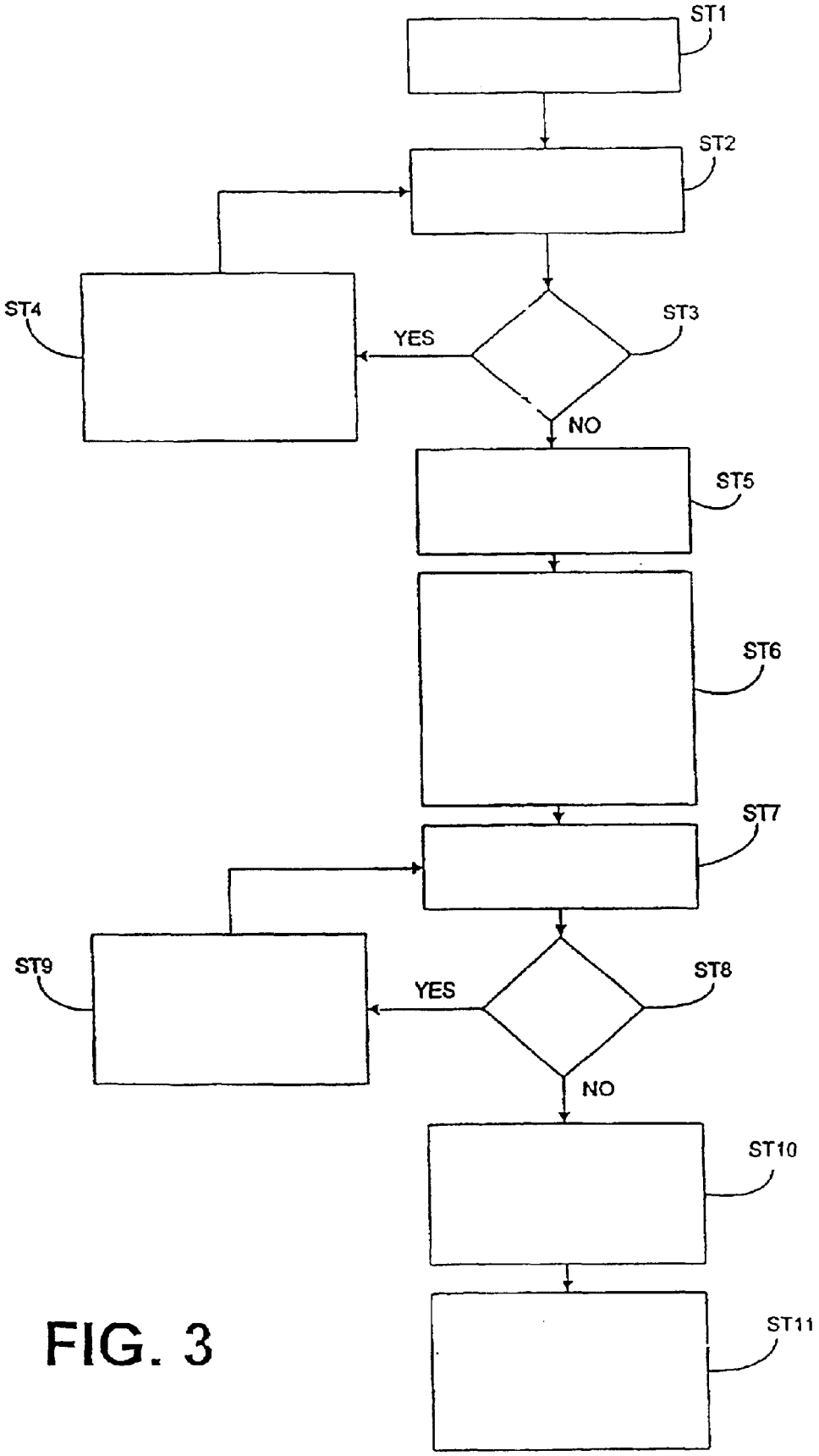
FIG. 3 is a flow chart illustrating a control parameter calculation routine according to an embodiment of the present invention.

FIG. 3 illustrates a control parameter calculation routine for calculating a control parameter value that results in a calculated environmental equivalency value that is within the desired range of environmental equivalency values. As used herein, the term "control parameter" refers to a process parameter being adjusted by the environmental equivalency calculator/controller 106, in order to control an evaporative drying process. The steps illustrated in FIG. 3 correspond to step ST7 in FIG. 2. For example, as stated above, for tablet film coating, the preferred control parameter is the spray rate. Additional or alternative control parameters that may be used include inlet gas temperature, inlet gas flow rate, and solution or dispersion percentage of solids.

In step ST1, the control parameter calculation routine calculates environmental equivalency using a control parameter value. The initial control parameter value may be any value, such as 1. The remaining parameters used to calculate environmental equivalency are measured from the tablet coating process. In steps ST2 and ST3, the control parameter calculation routine compares the calculated environmental equivalency value to the upper range limit of the desired range of environmental equivalency values. If the calculated environmental equivalency value exceeds the upper limit, the control parameter calculation routine varies the control parameter value and recalculates environmental equivalency using the new control parameter value (step ST4). For example, if the control parameter is spray rate, the control parameter calculation routine may increment the spray rate, because incrementing the spray rate decreases the calculated environmental equivalency value. For other parameters, such as gas flow rate, for which environmental equivalency varies directly, the control parameter calculation routine may decrement the initial control parameter value.

Steps ST1 through ST4 are repeated until the calculated environmental equivalency value no longer exceeds the upper limit. In step ST5, the control parameter calculation routine stores the control parameter value that resulted in the calculated environmental equivalency value being less than or equal to the upper limit. In step ST6, the control parameter calculation routine varies the control parameter value and recalculates environmental equivalency. In steps ST7 and ST8, the control parameter calculation routine compares the calculated environmental equivalency value to the lower limit of the desired range. If the calculated environmental equivalency value exceeds the lower range limit, the control parameter value is varied and environmental equivalency is recalculated using the varied control parameter value (step ST9).

Steps ST7–ST9 are preferably repeated until the calculated EE value no longer exceeds the lower range limit. In step ST10, the control parameter calculation routine stores the control parameter value that results in the environmental equivalency value that no longer exceeds the lower range limit. In step ST11, the control parameter calculation routine calculates the final control parameter value by averaging the stored control parameter values. Once the final control parameter value is calculated, control returns to step ST8 in FIG. 2 where the calculated control parameter value is applied to the film coating process.

The control parameter calculation routine illustrated in FIG. 3 produces a control parameter value designed to yield an environmental equivalency value in the process being controlled that is at or near the center of the desired environmental equivalency range. In a direct control embodiment, the control parameter value calculated by the control parameter calculation routine may be applied directly to the process being controlled. In an indirect control embodiment, the control parameter value may be communicated to the supervisory control 102, which then uses the calculated control parameter value to adjust the control parameter in the process.

Applying EE Control to Spray Drying

The present invention is not limited to using environmental equivalency to control tablet film coating in a pharmaceuticals manufacturing process. Using environmental equivalency to control any evaporative drying process both in a pharmaceuticals manufacturing process as well as in other manufacturing processes is intended to be within the scope of the invention. For example, in an alternative embodiment, the present invention includes methods and systems for controlling spray drying using environmental equivalency. Spray drying is a process that transforms a fluid, pumpable medium into a dry-powdered or particle form. This drying is achieved by atomizing the fluid into a drying chamber, where liquid droplets are passed through a gas stream. The objective is to produce a spray of high surface-to-mass ratio droplets. The droplets are ideally of equal size. Once the droplets are sprayed into the drying chamber, the water or other liquid is preferably quickly and uniformly evaporated. Spray drying may be a process in the pharmaceuticals manufacturing industry as well as a process in other industries such as food and confectionary processing, chemical or petro-chemical processing , pollution control, such as scrubbing, spray painting, semiconductor manufacturing, textiles manufacturing, or any other industry that utilizes evaporative drying process. In spray drying, the feed can be a solution, a suspension, or a paste. The dried product can be powdered, granulated, or agglomerated. The dried product characteristics depend on the feed, the dryer design, and process conditions. Spray drying delivers a powder of specific particle size and moisture content. In a continuous operation, the spray dryer delivers a highly controlled powder quality with relatively easy control.

In its simplest form, spray drying consists of four process stages:

- atomization of the feed;
- spray-gas contact;
- drying; and
- separation of the dried product from the drying gas.

Atomization is generally accomplished by one of three basic devices:

- a single-fluid or pressure nozzle;
- a two-fluid nozzle; or
- a rotary atomizer, also known as a spinning disc or a wheel.

The single-fluid nozzle allows more versatility in terms of positioning with the spray chamber so the spray angle or spray direction can be varied.

Since particle size is partially dependent on the feed rate, nozzles have limitations in terms of product characteristics and operating rates. Once the nozzle is in place, the rates can only be varied by pressure. Changing the orifice requires removing the nozzle. In high-volume operations, several nozzles are located within the chamber and positioned so that constant evaporation conditions are maintained around each nozzle. For more viscous or abrasive feeds, two fluid nozzles are utilized, with a gas, such as air, being the second medium to move the feed and effectively atomize it. Air can be mixed internally with the nozzle or externally to the nozzle. In situations in which small particle sizes might not be possible with a single fluid nozzle, the two-fluid nozzle can provide the necessary additional atomization. However, this produces a much wider particle size range. Fluid feeds can also be dispersed and atomized by centrifugal force on a rotary or spinning disc. Liquid feed is accelerated to greater than 300 feet per second to produce very fine droplets. Particle size is primarily controlled by wheel speed. In centrifugal systems, the liquid feed is distributed in the center of the wheel or disc, travels over the surface as a thin film, and is flung from the edge as small droplets. Vanes or a rough-surface wheel can minimize slippage of the fluid as it is flung to the outside of the wheel.

Any number of dryers may be used to spray dry a pharmaceutical or other product. Exemplary dryers suitable for use with embodiments of the present invention include cylindrical flat-bottom dryers and conical-bottom dryers such as the HT and the Virtis, Model No. SPO-4, both available from Niro Incorporated. The drying gas within the chamber of a dryer maintains a flow pattern, preventing deposition of partially dried product on the wall of the chamber or atomizer. Drying gas movement can be co-current, countercurrent, or mixed flow. Drying gas movement and temperature of the inlet gas influence the type of final product. Maintaining the surface wetness of the particle is important to constant rate drying. If the drying gas temperature is too high, a dried layer may form at the surface, decreasing evaporation. Drying occurs in two phases, and drying gas temperature control is vital to control these phases. The first phase is the constant-rate step, in which moisture rapidly evaporates from the surface, and capillary action draws moisture from within the particle. In the second or falling-rate period, diffusion of water to the surface controls the drying rate. As moisture content drops, a single stage dryer is responsible for most of the residence time in the dryer. As a rule, the residence time of the drying gas and the particle in a single stage co-current dryer are about the same. Since the moisture level is still decreasing toward the end of the process, the outlet temperature must be high enough to continue the drying process. Adding a fluid bed after the dryer can ensure completion of the drying process.

The final phase of spray drying is removing the dried product from the drying gas in an economical and pollutant-free manner. Generally, economy depends on the ability to recycle the drying gas, so removing fines from the drying gas is very important. Depending on the dryer design, the dried product can be separated at the base, as in a flat-bottom dryer, and fines collected in some type of collection equipment. Alternatively, the entire product and drying gas can be removed to equipment designed to separate particles from drying gas. Heavier product is removed by gravity, but fines require additional means for removal. The fines may be removed with cyclones, bag filters, electrostatic precipitators, or scrubbers. Fines are bagged or returned to an agglomeration process and the drying gas is returned to the system.

According to conventional spray drying methods, maintaining optimal process parameters for spray drying is similar to the conventional methods for maintaining optimal parameters for tablet film coating, as described above. In other words, optimal process parameters are determined empirically, and then applied to produce a production quality product If one or more parameters changes during processing of a given batch of material, the end product quality will be reduced. In addition, the same problems of lack of scalability and inability to adapt to process changes that apply to tablet film coating also apply to spray drying. For example, spray dryers are generally designed to maintain constant drying gas flow rates. Inlet gas temperature is preferably set so that solution can be sprayed into the dryer at a feed rate as high as possible. Once inlet gas temperature and gas flow rate are set, the feed rate is then set according to the desired product quality. If humidity, temperature, or flow rate of the drying gas varies, the feed rate may require adjustment.

Environmental equivalency can be used to maintain product quality when one or more of the parameters changes during a process. The process steps illustrated in FIGS. 2 and 3 may be applied to spray drying. First, a desired range of environmental equivalency values may be determined for a spray drying process. The desired range may be determined empirically by examining product quality and calculating a range of environmental equivalency values that achieves the desired product characteristics. Since spray drying processes are typically drier than tablet film coating processes, the preferred range of environmental equivalency values for spray drying may be higher than the preferred range for tablet film coating given above.

Once the desired range of environmental equivalency values is determined, the range may be used to implement a control system, similar to the control system illustrated in FIG. 1, to control one or more parameters, such as an optimum feed rate. The process steps in FIG. 2 can be used to control a film coating process. The process steps illustrated in FIG. 3 may be used to calculate a feed rate that results in environmental equivalency falling within the desired range of values.

Controlling Fluid bed Processing Using Environmental Equivalency

According to another embodiment, the present invention may include methods and systems for controlling fluid bed processing using environmental equivalency. As with the other embodiments of the invention set forth herein, the methods and systems for controlling fluid bed processing are not intended to be limited to only the pharmaceuticals manufacturing industry, but to include other industries such as food and confectionary processing, chemical or petrochemical processes, pollution control, such as scrubbing, spray painting, semiconductor manufacturing, textiles manufacturing, or any other industry that utilizes evaporative drying process. Fluid bed processing is used to granulate, coat, and/or agglomerate particles. In fluid bed processing, a bed of material to be granulated, coated, or agglomerated is located in an enclosed chamber. The bed is "fluidized" by passing a heated gas, such as air, through a distribution plate, through the bed, and into the chamber. When powders in the material are adequately mixed and fluidized, a liquid, which may or may not contain other functional components, is added through a spray nozzle, typically located above the bed. For other processes, the nozzle may be located below the bed. When the desired granule properties are obtained, spraying of the liquid is discontinued but the fluidization is maintained until the desired product moisture content is obtained by drying. During the spraying process, the controls result in a thermodynamic equilibrium between the rate of addition and rate of removal of liquid from the system.

During drying, the process is dictated by the removal of the liquid from the granules. Conventional fluid bed processing in the pharmaceutical industry and the equipment used thereby is described in *Air Suspension Technique of Coating Drug Particles*, by Dale E. Wurster, D. E. J. Am. Pharm. Assoc. Sci. Ed. 1959, 48 (8), 451–454 and *Preparation of Tablet Granulations by the Air Suspension Technique*, by Dale E. Wurster, D. E. J. Am. Pharm. Assoc. Sci. Ed. 1960, 49 (2), 82–84, the disclosures of each of which are incorporated herein by reference.

In fluid processing, the typical parameters used to control the process include:

- Fluidizing gas flow rate (typically cubic feet per minute, cfm, or cubic meters per hour, cmh) through the product bed (fluidizing gas);
- Dew point of the fluidizing gas;
- Temperature of the fluidizing gas;
- Dissolved solids in the granulating liquid;
- Application rate of the granulating liquid (spray rate);
- Temperature of the fluidizing gas leaving the equipment (exhaust gas temp); and
- Temperature of the product during the process.

Only by combining appropriate levels of these factors, can proper granules be produced. Since the process is governed by thermodynamics, environmental equivalency can be used to design or control this process by monitoring gas flow rate, dew point, temperatures and spray rate and making appropriate adjustments if any of these parameters change during the process.

In this process, the fluidizing gas flow rate must be sufficient to properly fluidize the bed. Therefore, fluidizing gas flow rate needs to be measured to calculate an EE value. Fluidizing gas flow rate, dew point of the fluidizing gas, temperature of the fluidizing gas, and spray rate are possible parameters that may be measured and varied to maintain a desired EE value or desired range of EE values.

In fluid bed processing, the method for characterizing the desired EE value may be different from the characterization for the tablet film coating application. For example, in tablet film coating, AQI. may be used to measure product output quality and determine a desired range of EE values corresponding to the product output quality. For fluid bed granulation, particle size distribution, moisture content, or a drug release profile, (if a sustained release material is being applied to the powders) may be used to measure product quality and determine a desired range of EE values.

Once a desired range of environmental equivalency values is selected, the range is preferably programmed into an EE calculator/controller 106, as described with respect to FIG. 1. Control may proceed in a manner similar to the routine illustrated in FIG. 2. For example, the spray rate, gas flow rate, and gas temperature may each be set to initial values. The fluid bed processing operation may then be started using the initial values. As more particles are agglomerated, new values for the spray rate may be calculated and applied to the process to maintain the desired range of environmental equivalency values. Alternatively, new values for the gas flow rate and temperature may be calculated and applied to maintain a desired environmental equivalency value. The spray rate, the gas flow rate, or the temperature may be calculated in the manner described with respect to FIG. 3. Thus, the environmental equivalency-based control systems according to the present invention may be used to maintain product quality in fluid bed processing of pharmaceutical compositions in the pharmaceuticals manufacturing industry or other industries.

Catastrophic Failure Detection Using Environmental Equivalency

According to another aspect, the present invention includes a catastrophic failure detection routine. The catastrophic failure detection routine detects when one or more of the process parameters associated with an evaporative drying process exceeds acceptable operating ranges due to catastrophic failure, such as equipment failure or natural disaster. For example, in a film coating process, if the pump that supplies the process liquid to the nozzle fails, a catastrophic failure occurs and the process should be stopped and/or an operator should be alerted. In conventional evaporative drying processes, there was no mechanism that allowed automatic shutdown of a process based on environmental equivalency. As a result, conventional evaporative drying processes required constant monitoring by technicians in order to determine the presence of a catastrophic failure. The present invention alleviates these difficulties by determining whether a catastrophic failure has occurred based on environmental equivalency.

Figure 4:
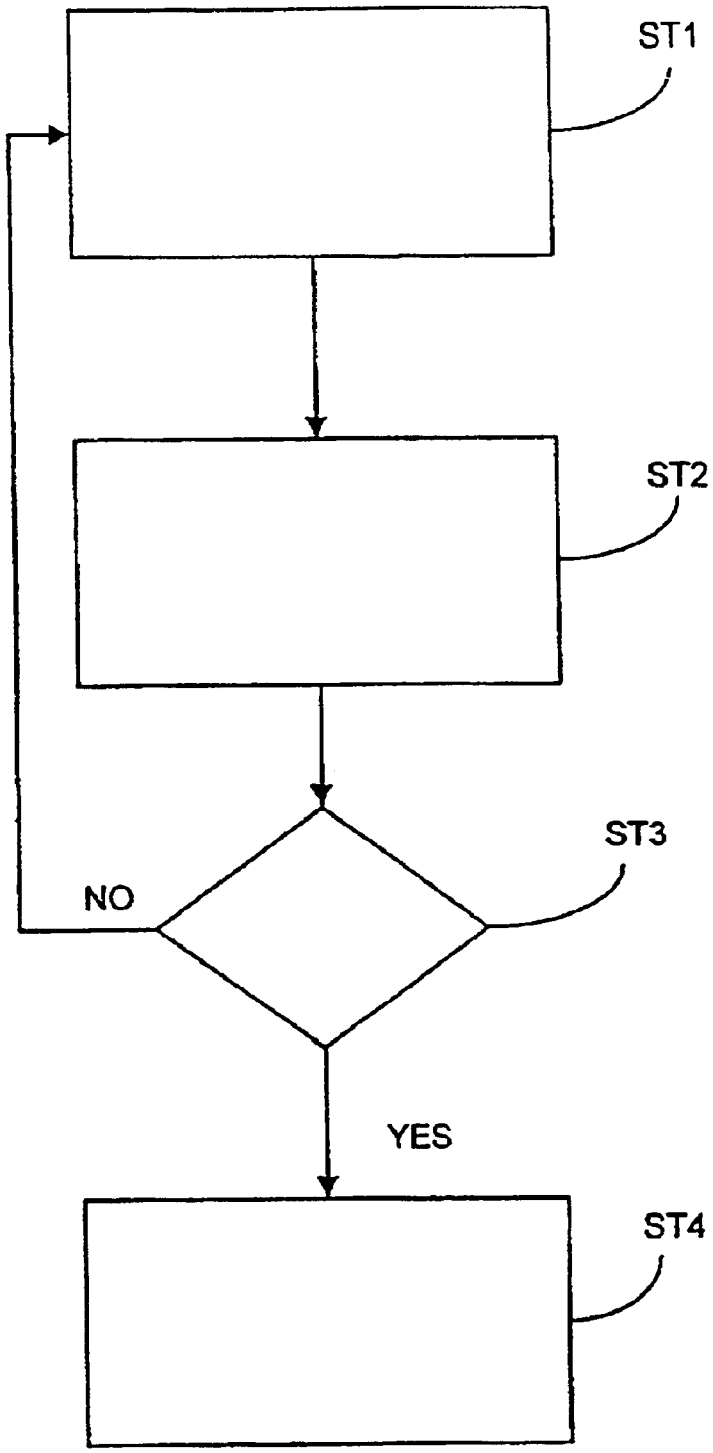
FIG. 4 is a flow chart illustrating a catastrophic failure detection routine according to an embodiment of the present invention.

FIG. 4 is a flow chart illustrating an exemplary catastrophic failure detection routine according to the present invention. The steps illustrated in FIG. 4 may be executed by a controller, such as a programmable logic controller, a computer, or any other combination of hardware, software, or hardware and software, used to control an evaporative drying process.

In step ST1, the catastrophic failure detection routine calculates an EE value based on measured process parameters. The process parameters may be spray rate, dew point, inlet gas temperature, inlet gas flow rate, and solution/dispersion percentage of solids. The EE value may be calculated using the equation described above. In step ST2, the catastrophic failure detection routine compares the EE value to a safe operating range of EE values. The safe operating range may be determined experimentally based on analysis of product quality or previous machine failures. The safe operating range is preferably wider than the range for which EE values are controlled, as illustrated in FIG. 3. In step ST3, the catastrophic failure detection routine determines whether the safe operating range has been exceeded. If the calculated EE value is greater than the upper range limit or less than the lower range limit, the catastrophic failure detection routine takes appropriate action for catastrophic failure (step ST4). For example, the catastrophic failure detection routine may activate an audible or visible alarm and/or shut down the operation being performed. Because the catastrophic failure detection routine detects the presence of a catastrophic failure based on environmental equivalency, multiple process parameters can be simultaneously monitored with reduced human intervention.

Manual Calculation of Environmental Equivalency and/or Adjustment of Control Parameters Although the present invention is preferably implemented as an automatic control system for controlling an evaporative drying process using environmental equivalency, the present invention is not limited to such an embodiment. For example, in an alternative embodiment, process parameters may be manually adjusted by a technician based on environmental equivalency. For example, a technician may perform steps similar to those illustrated in FIG. 2 to manually adjust process parameters to maintain a desired range of environmental equivalency values. The technician may monitor process parameters through a human machine interface. Based on the process parameters, the technician may calculate the environmental equivalency value for the process. The calculation of the environmental equivalency value may be performed manually or automatically. For example, the technician may calculate the environmental equivalency value using a spreadsheet or other computer program adapted to calculate environmental equivalency, using a calculator, or using a pencil and paper. The technician may then manually adjust one or more process parameters to maintain the environmental equivalency value within the desired range of environmental equivalency values. The technician may re-calculate environmental equivalency and readjust process parameters periodically, according to the process being monitored. Any combination of manual and automatic adjustment of control parameters and calculation of environmental equivalency is within the scope of the invention.

Application of Environmental-Equivalency-Based Control to Other Industries

As stated above, the methods and systems for controlling evaporative drying processes using environmental equivalency is not limited to pharmaceuticals manufacturing processes. Applying environmental equivalency-based control, as described above, to any industry that includes evaporative drying processes is within the scope of tire invention. The following paragraphs describe other industries that include evaporative drying processes and how environmental equivalency may be used to increase processing efficiency in each of the industries.

Food and Confectionary Processing

Food and confectionary processing industries share many common processes with the pharmaceutical industry. For example, powdered milk is produced using spray drying. Therefore, the methods and systems for applying environmental equivalency based control to spray drying described above may be used to produce spray dried food products, such as powdered milk.

Confectionary production, such as candy production, may also have common processes with the pharmaceuticals manufacturing industry. For example, m & m's® are film coated. Therefore, the methods and systems for applying environmental-equivalency-based control described above for tablet film coating can be applied to confectionary production.

Chemical and Petro-Chemical Processing

Synthetic or isolation techniques, such as those which isolate or purify extractions of organic solvents utilize evaporative processes to isolate desired components. Examples of chemical and petro-chemical products in which evaporative processes are used include but are not limited to, polymers, peptides, organic hydrocarbons, fossil fuels. These products may be produced using a fractional distillation system. A fractional distillation system includes a still, a fractionating column, a condenser, and a receiver connected in series. A material desired to be purified, such as crude oil, is heated in the still. The heated material produces a gas. The gas ascends the fractionating column. From the fractionating column, the gas enters the condenser, where the material is cooled to form a liquid. Some of the liquid is fed back into the fractionating column, and the remaining liquid is collected in a receiver. The distillation process can be continuous or intermittent. In a continuous process, the still is fed continuously with a material to be purified. In an intermittent process, material is purified in batches.

Environmental equivalency based control may be applied to a fractional distillation system to determine optimal process parameters, such as vapor flow rate, temperature, and feed rate. For example, a desired environmental equivalency value may be experimentally determined for a continuous distillation process by monitoring product quality, e.g., by measuring purity. Once the desired environmental equivalency value is determined, one or process parameters may be controlled using the EE calculator/controller described above to maintain that value or a predetermined range of values, even when one or more of the other process parameters changes.

Textiles and Sheet Goods

Environmental equivalency may be used to control the application of liquids or suspensions to woven or non-woven fabrics or other materials in a free air stream. Examples of liquids or suspensions that may be applied in this manner include polytetrafluoroethylene (PTFE), liquid crystals, single surface waterproofing material. Because these processes include the spraying of one material onto another material in a free air stream, these processes may be controlled in a manner similar to tablet film coating, as described above. Thus, the environmental-equivalency-based control system described with respect to FIGS. 1–3 may be applied to textiles and sheet goods manufacturing processes that include spraying.

Semiconductor Manufacturing

In semiconductor manufacturing, thin films of dielectrics, such as $SiO_2$, $Si_3N_4$, etc., polysilicon, and metal conductors are deposited on a wafer surface to form devices and circuits. The techniques used for depositing these films are chemical vapor deposition (CVD) and physical vapor deposition (PVD). One method of performing PVD is to heat the coating material in a vacuum such that the coating material evaporates. The wafer or substrate is placed in a holder near the coating material source to allow the evaporated particles to deposit on the substrate. An environmental equivalency value for PVD may be determined by analyzing coating output quality, such as thickness or uniformity. Once a desired EE value has been determined, one or more processing parameters may be controlled to maintain the desired EE value or range of EE values. For example, since the evaporation rate controls the amount of coating material in the atmosphere around the substrate, the evaporation rate and or exposure time may be varied to maintain the desired EE value or range of EE values. The EE calculator/controller described above may be used to maintain the calculated environmental equivalency value within the predetermined range. The control parameter calculation routine described above may be used to calculate the desired evaporation rate.

In CVD, films are deposited on a substrate using reactant gases and an energy source to produce a gas phase chemical reaction. The growth rate of material on the surface of the substrate can be controller by controlling substrate temperature. Like PVD, a desired EE value can be determined by monitoring product output quality. The EE calculator/controller described above may be used to vary temperature and/or exposure time values to maintain a desired environmental equivalency value or range of environmental equivalency values.

Paint Coatings, Photographic Films, and Adhesives Application

The application of spray coatings such as painting or electroplating in a free airstream involves principles similar to those for tablet film coating, as described above. Thus, EE-based control systems may be used to control process parameters, such as the spray rate, in a manner similar to that described above for tablet film coating. Examples of coating processes in which environmental equivalency may be used to maintain a desired output product quality include but are not limited to painting, photographic film coating, polymeric coatings, and building materials manufacture, such as oriented strand board (OSB) manufacture.

Environmental Applications

Environmental equivalency may be used to control the introduction of liquids into gas streams to remove particulate contaminates and or increase clarity. Examples of applications for environmental equivalency based control include but are not limited to smokestack scrubbers, cooling towers, boiler inlet airflow. For example, in spray scrubbers, a liquid, such as water, is sprayed into a tower of upward moving gas containing the contaminants that are desired to be removed. The contaminants are wetted by the water and fall to the bottom of the chamber where they are removed. A desired environmental equivalency value or range of values may be determined for the scrubbing process by measuring the product output quality, e.g., the percentage of contaminants in the air exiting the tower. Once a the desired value or range of values is determined, the spray rate may be controlled to maintain the desired EE value or range of EE values in the manner described above with respect to spray drying.

It will be understood that various details of the invention may be changed without departing from the scope of the invention. Furthermore, the foregoing description is for the purpose of illustration only, and not for the purpose of limitation—the invention being defined by the claims.

What is claimed is:

1. An environmental equivalency calculator/controller for controlling an evaporative drying process using environmental equivalency, the environmental equivalency calculator/controller comprising:

(a) means for continuously receiving measured values for inlet gas temperature, dew point, gas flow rate, and spray rate in an evaporative drying process;

(b) means for calculating an environmental equivalency value for the evaporative drying process based on the measured values; and (c) means for outputting a control signal to vary one or more process parameters associated with the evaporative drying process to maintain the environmental equivalency value within a predetermined range.

2. The environmental equivalency calculator/controller of claim 1, wherein the means for outputting a control signal is adapted to output a control signal for varying the spray rate in the evaporative drying process.

3. The environmental equivalency calculator/controller of claim 2, comprising means for calculating a spray rate value to maintain the environmental equivalency value within a predetermined range.

4. The environmental equivalency calculator/controller of claim 1, wherein the means for outputting a control signal is adapted to output a control signal for varying the inlet gas temperature in the evaporative drying process.

5. The environmental equivalency calculator/controller of claim 1, wherein the means for outputting a control signal is adapted to output a control signal for varying the inlet gas flow rate.

6. The environmental equivalency calculator/controller of claim 1, wherein the means for outputting a control signal is adapted to output a control signal for varying the dew point.

7. The environmental equivalency calculator/controller of claim 1, wherein the means for outputting a control signal is adapted to output a control signal for varying solution/dispersion percentage of solids of a material being sprayed in the evaporative drying process.

8. The environmental equivalency calculator/controller of claim 1, wherein the means for continuously receiving, the means for calculating, and the means for outputting comprise a programmable logic controller (PLC).

9. The environmental equivalency calculator/controller of claim 1, wherein the means for continuously receiving, the means for calculating, and the means for outputting comprise a computer.

10. The environmental equivalency calculator/controller of claim 1, wherein the evaporative drying process is an aqueous film coating process and wherein the means for outputting a control signal is adapted to output control signals for maintaining the environmental equivalency value within a range of from about 3.7 to no more than about 5.2 for the aqueous film coating process.

11. The environmental equivalency calculator/controller of claim 1, wherein the evaporative drying process is an aqueous film coating process and wherein the means for outputting a control signal is adapted to output control signals for maintaining an environmental equivalency value of about 4.4 for the aqueous film coating process.

12. The environmental equivalency calculator/controller of claim 1, wherein the evaporative drying process is a tablet film coating process.

13. The environmental equivalency calculator/controller of claim 1, wherein the evaporative drying process is a spray drying process.

14. The environmental equivalency calculator/controller of claim 1, wherein the evaporative drying process is a fluid bed granulation or agglomeration process.

15. The environmental equivalency calculator/controller of claim 1, wherein the evaporative drying process is a pharmaceuticals manufacturing process.

16. The environmental equivalency calculator/controller of claim 1, wherein the evaporative drying process is a food or confectionary manufacturing process.

17. The environmental equivalency calculator/controller of claim 1, wherein the evaporative drying process is a chemical or petro-chemical isolation or purification process.

18. The environmental equivalency calculator/controller of claim 1, wherein the evaporative drying process is a textiles or sheet goods coating process.

19. The environmental equivalency calculator/controller of claim 1, wherein the evaporative drying process is a deposition process in a semiconductor manufacturing process.

20. The environmental equivalency calculator/controller of claim 1, wherein the evaporative drying process is a coating process.

21. The environmental equivalency calculator/controller of claim 1, wherein the evaporative drying process is a contaminant removal process.

22. An environmental equivalency calculator/controller for controlling an evaporative drying process using environmental equivalency, the environmental equivalency calculator/controller comprising computer-executable instructions embodied in a computer-readable medium for performing steps comprising:

(a) continuously receiving measured values for inlet gas temperature, dew point, gas flow rate, and spray rate in an evaporative drying process;

(b) calculating an environmental equivalency value for the evaporative drying process based on the measured values; and (c) outputting a control signal to vary one or more process parameters associated with the evaporative drying process to maintain the environmental equivalency value within a predetermined range.

23. The environmental equivalency calculator/controller of claim 22, wherein outputting a control signal includes outputting a control signal for varying the spray rate in the evaporative drying process.

24. The environmental equivalency calculator/controller of claim 23, comprising calculating a spray rate value to maintain the environmental equivalency value within a predetermined range.

25. The environmental equivalency calculator/controller of claim 22, wherein outputting a control signal includes outputting a control signal for varying the inlet gas temperature.

26. The environmental equivalency calculator/controller of claim 22, wherein outputting a control signal includes outputting a control signal for varying the inlet gas flow rate.

27. The environmental equivalency calculator/controller of claim 22, wherein outputting a control signal includes outputting a control signal for varying the dew point.

28. The environmental equivalency calculator controller of claim 22, wherein outputting a control signal includes outputting a control signal for varying a solution/dispersion percentage of solids of a material being sprayed in the evaporative drying process.

29. The environmental equivalency calculator/controller of claim 22, wherein the evaporative drying process is an aqueous film coating process and wherein outputting a control signal includes outputting a control signal to maintain the environmental equivalency value within a range of from about 3.7 to no more than about 5.2 for the aqueous film coating process.

30. The environmental equivalency calculator/controller of claim 22 wherein the evaporative drying process is an aqueous film coating process and wherein outputting a control signal includes outputting a control signal to maintain an environmental equivalency value of about 4.4 for the aqueous film coating process.

31. The environmental equivalency calculator/controller of claim 22, wherein the evaporative drying process is a tablet film coating process.

32. The environmental equivalency calculator/controller of claim 22, wherein the evaporative drying process is a spray drying process.

33. The environmental equivalency calculator/controller of claim 22, wherein the evaporative drying process is a fluid bed granulation or agglomeration process.

34. The environmental equivalency calculator/controller of claim 22, wherein the evaporative drying process is a food or confectionary manufacturing process.

35. The environmental equivalency calculator/controller of claim 22, wherein the evaporative drying process is a chemical or petro-chemical isolation or purification process.

36. The environmental equivalency calculator/controller of claim 22, wherein the evaporative drying process is a textiles or sheet goods coating process.

37. The environmental equivalency calculator/controller of claim 22, wherein the evaporative drying process is a deposition process in a semiconductor manufacturing process.

38. The environmental equivalency calculator/controller of claim 22, wherein the evaporative drying process is a coating process.

39. The environmental equivalency calculator/controller of claim 22, wherein the evaporative drying process is as contaminant removal process.

40. A system for controlling an evaporative drying process using environmental equivalency, the system comprising:

(a) a plurality of sensors for determining measured values for parameters associated with an evaporative drying process; and (b) an environmental equivalency calculator/controller for receiving the measured values, calculating an environmental equivalency value for the process, and controlling the parameters to maintain the environmental equivalency value within a preferred range of values.

41. The system of claim 40, wherein the evaporative drying process is an aqueous film coating process and wherein the environmental equivalency calculator/controller is adapted to maintain the environmental equivalency value within a range of from about 3.7 to about 5.2 for the aqueous film coating process.

42. The system of claim 40, wherein the environmental equivalency calculator/controller is adapted to maintain the environmental equivalency value within a predetermined range such that the acceptable quality level (AQL) of the product being produced is about 0.65.

* * * * *